United States Patent [19]

Brouwer

[11] 4,351,243

[45] Sep. 28, 1982

[54] PIVOTED RAILWAY HOPPER CAR DOOR LATCH

[75] Inventor: Cornelis Brouwer, Potchefstroom, South Africa

[73] Assignee: Rotaque (Proprietary) Limited, Potchefstroom, South Africa

[21] Appl. No.: 188,413

[22] Filed: Sep. 18, 1980

Related U.S. Application Data

[63] Continuation of Ser. No. 903,300, May 5, 1978, abandoned.

[51] Int. Cl.[3] ..... B61D 7/04; B61D 7/18; B61D 7/30

[52] U.S. Cl. ..... 105/241.2; 105/250; 105/308 R; 105/308 P

[58] Field of Search ..... 105/241.1, 241.2, 250, 105/308 R, 308 P

[56] References Cited

U.S. PATENT DOCUMENTS 1,594,863 8/1926 Warner ..... 105/241.1 X
3,790,008 2/1974 Joubert ..... 105/250 X
4,062,460 12/1977 Adler ..... 105/241.2 X

*Primary Examiner*—Bruce H. Stoner, Jr.
*Assistant Examiner*—Howard Beltran
*Attorney, Agent, or Firm*—Pollock, Vande Sande & Priddy

[57] ABSTRACT

A hopper car structure having a hopper body with a discharge opening at the bottom. A pivotally hung door having an arcuate base plate normally closes said opening and an arm is pivotally mounted on the door. A roller is carried by the arm on its free end and is intended to engage a ramp. The arm, in the closed condition of the door, has an abutment surface thereof spaced downwardly from an abutment surface of the door. When said roller engages an upwardly inclined ramp, the arm pivots upwardly with respect to the door until the abutment surface of the arm engages the abutment surface of the door. The door and arm then swing together about the pivotal mountings of the door to the open position of the door. The arm is locked against movement while the door is in its closed position and the abutment surface of the arm is spaced below the abutment surface of the door.

5 Claims, 9 Drawing Figures

PIVOTED RAILWAY HOPPER CAR DOOR LATCH

This application is a continuation of U.S. Pat. application, Ser. No. 903,300 filed May 5, 1978, now abandoned.

This invention relates to bottom discharge hopper structures.

According to the present invention, there is provided a bottom discharge hopper structure comprising a pivotally hung door having an abutment surface, a tipping arm pivotally mounted on the door and also having an abutment surface, the arm having a first position with respect to the door in which first position of the arm said abutment surfaces are spaced apart and a second position with respect to the door in which second position said abutment surfaces are in engagement, a fixed latching element, and a face on said arm which face is in engagement with said latching element while said arm is in its first position with respect to the door, the latching element preventing pivotal movement of the arm and door about the pivotal mounting of the door until the arm has been pivoted sufficiently about its mounting on the door towards said second position to take up at least some of the gap which exists between said abutment surfaces while the arm is in its first position.

Said face preferably lies laterally of the pivotal mounting of the arm on the door.

The abutment faces can be an upper face of the arm and a lower face of the door, the door and arm moving together about the pivotal mounting of the door while said faces are in engagement, and said arm being free to move downwardly with respect to the door about its pivotal mounting on the door after the door reaches its fully closed position, whereby said abutment face on the arm moves to a position in which it is spaced below the abutment surface on the door.

The door preferably comprises two end plates which hang from pivot structures and an elongated plate of arcuate cross-section which joins said end plates, and the elongated end plate is desirably generated about an axis offset with respect to the axis of the pivot structures of the door in such manner that said elongated plate moves both downwardly and laterally with respect to parts which bound a discharge opening of the hopper, thereby causing a gap of progressively increasing width to be created between said door and said parts during opening.

While the end of the arm remote from its pivotal mounting on the door can slide on a cam track, it is more desirable to provide a roller on the end of the arm remote from its mounting on the door.

The invention also provides, in combination, a cam track and a hopper structure as defined in the preceding paragraph, said roller engaging on said cam track as the vehicle moves past the cam track, the axis of rotation of said roller being radial to the axis about which said door pivots, and the cam track being profiled so that the line of action of the force exerted by the cam track on said element is always tangential to the arc scribed by said arm and said door about the pivotal mounting of the door.

For a better understanding of the present invention, and to show how the same may be carried into effect, reference will now be made, by way of example, to the accompanying drawings in which.

Figure 1:
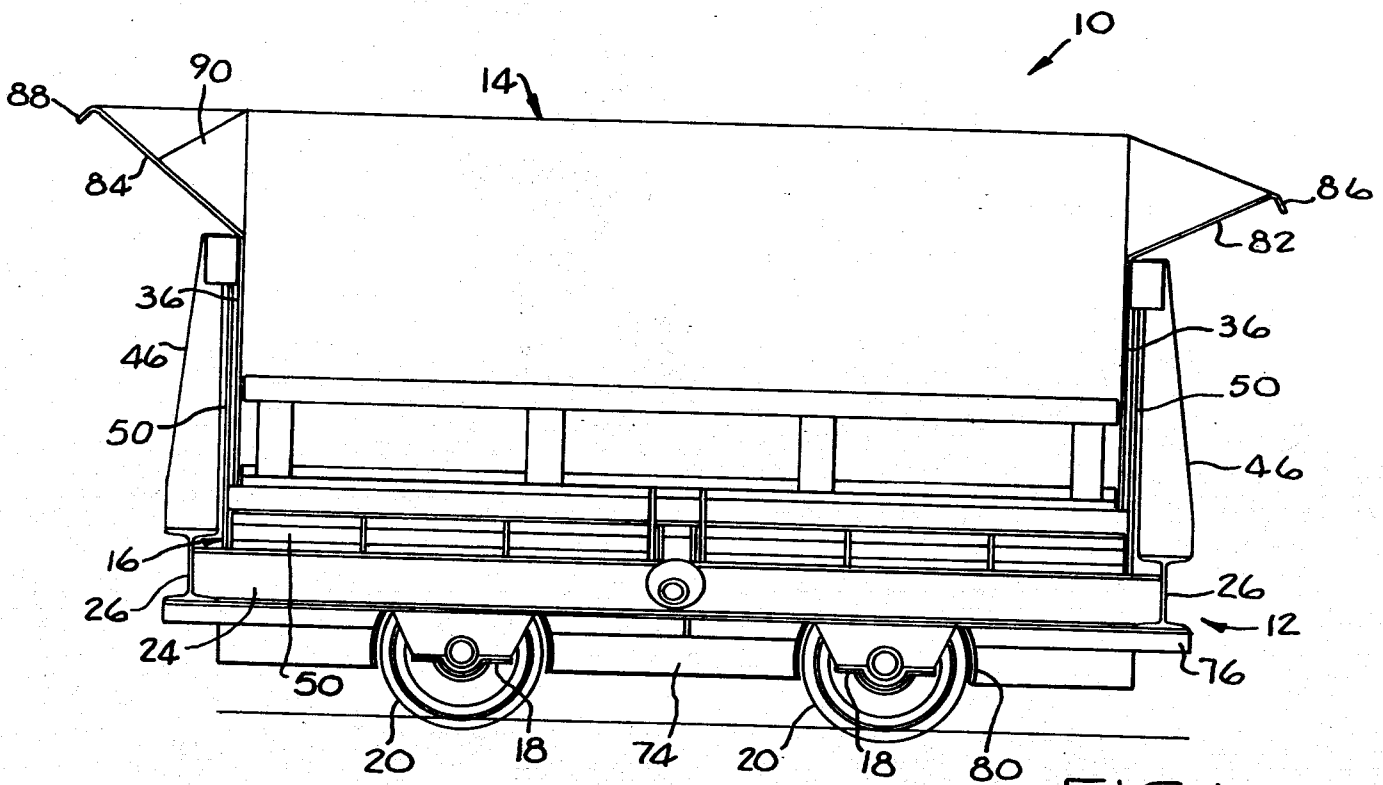
FIG. 1 is a side elevation of a bottom discharge hopper car.
Figure 2:
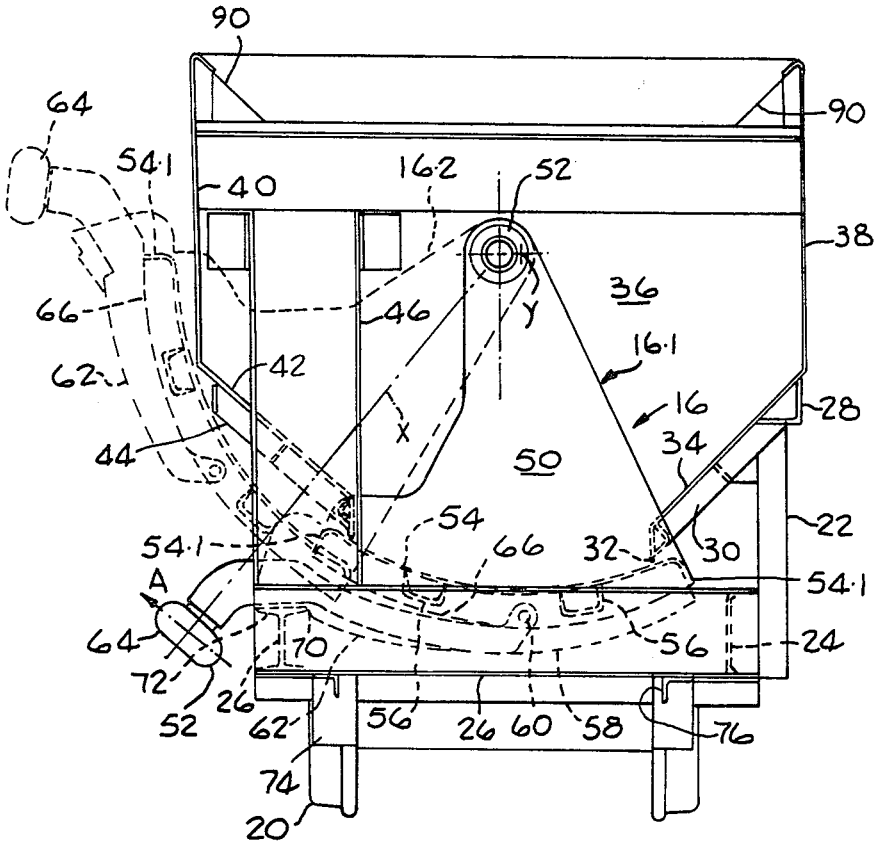
FIG. 2 is an end elevation of the hopper car of FIG. 1.
Figure 4:
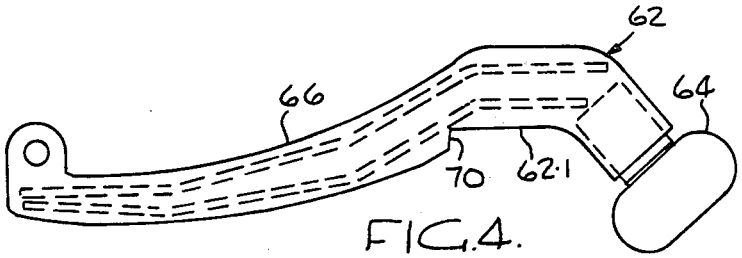
FIG. 4 is a side elevation of a tipping arm.
Figure 5:
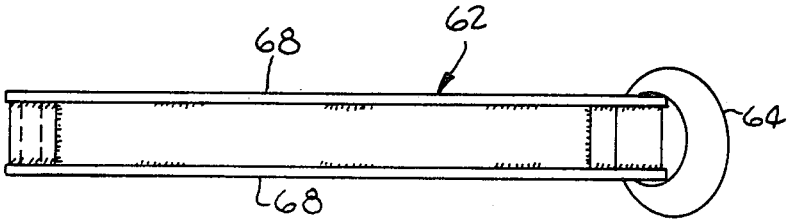
FIG. 5 is a top plan view of the arm of FIG. 4.
Figure 3:
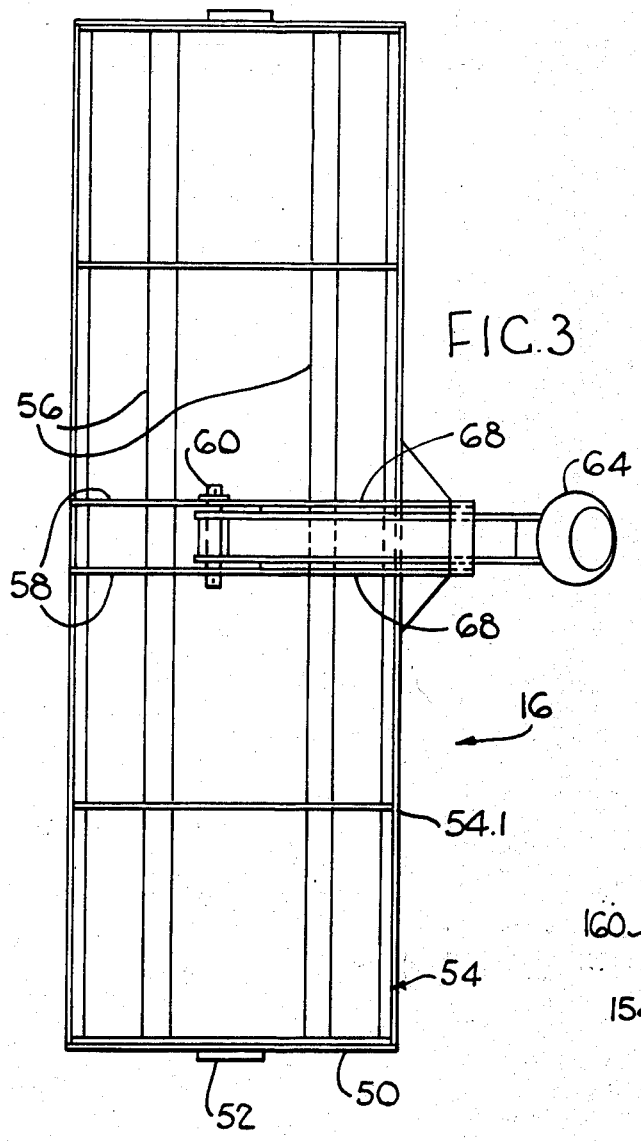
FIG. 3 is an underneath plan view of the door of the car.
Figure 8:
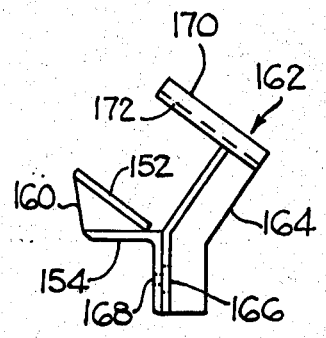
FIG. 8 is an end elevation of a bracket structure on the ramp.
Figure 9:
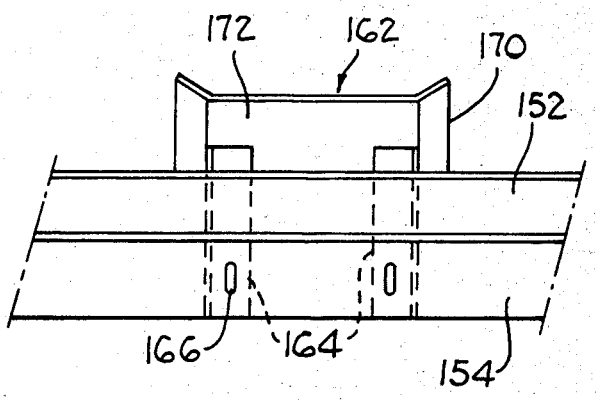
FIG. 9 is a front elevation of the bracket structure of FIG. 8.

The hopper car illustrated in FIGS. 1 and 2 is generally referenced 10 and comprises a chassis 12, a hopper body 14, and a door 16.

The chassis 12 includes two sets of wheel bearings 18 which mount flanged wheels 20. A series of supports 22 extend upwardly from a frame which forms a major part of the chassis 12 and which is itself constituted by a longitudinal channel iron 24 and longitudinal and transverse I-beams 26. The supports 22 are welded to the longitudinal channel iron 24.

An angle iron 28 is mounted on the supports 22 and stiffeners 30 extend downwardly from the angle iron 28 towards the free lower edge 32 of a sloping wall 34 of the hopper body 14.

In addition to the sloping wall 34, the hopper body 14 comprises two end walls 36, a vertical wall 38 extending upwardly from the sloping wall 34, a further vertical wall 40 which is parallel to, and spaced laterally from, the vertical wall 38, and a further sloping wall 42. The sloping wall 42 is strengthened by stiffeners 44 which extend from the region of the convergence between the vertical wall 40 and the sloping wall 42 to the lower edge of the wall 42.

As will be clearly understood from the following description, the door 16 swings between the full and dotted line positions illustrated at 16.1 and 16.2 in FIG. 2. To permit this movement to take place, while still providing some support for the hopper body on this side of the car, two vertically elongated supports 46 of I-section are provided. The supports 46 extend between the transverse I-beams 26 of the frame 14 and are secured to the walls 36.

The door 16 comprises two approximately triangular end plates 50 which are carried pendulum fashion by overhead pivot structures 52. The overhead pivot structures 52 mount the end plates 50 on the end walls 36 of the hopper body 14.

The door 16 further includes a curved base plate 54 (the concave face of the base plate being uppermost) which extends between and is secured to the end plates 50. The base plate 54 is strengthened by a pair of channels 56 which extend downwardly from the underside thereof. The edges 54.1 of the base plate 54 are turned downwardly which also enhances its strength.

Centrally of the door, that is, midway between the plates 50, the door is provided with two curved, transversely extending stiffeners 58. A pivot pin 60 is mounted on the parallel stiffeners 58 and the pin 60 pivotally mounts an arm 62. The arm has a roller 64 rotatably mounted at the outer end thereof.

Figure 6:
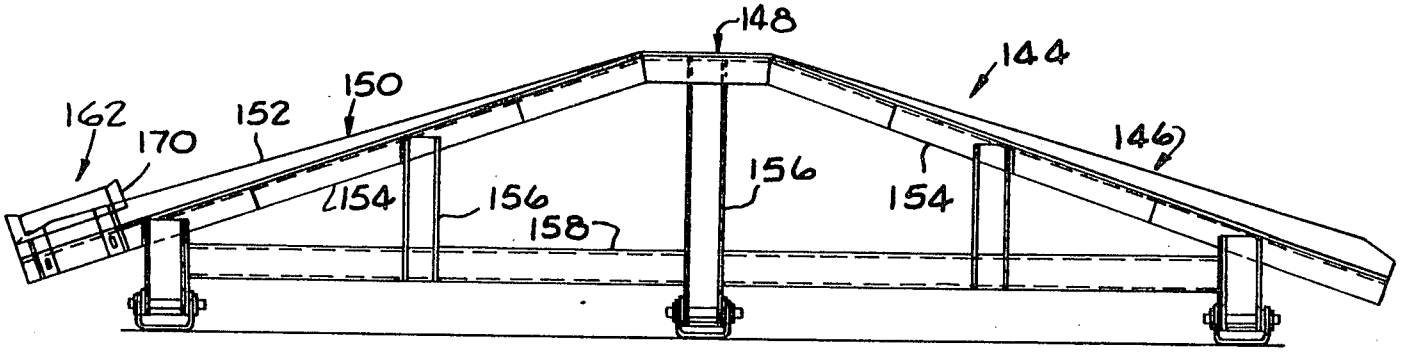
FIG. 6 is a side elevation of a ramp structure.
Figure 7:
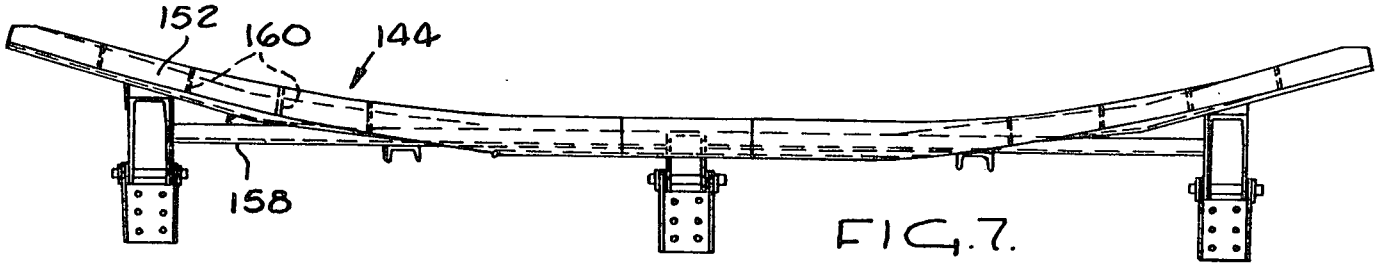
FIG. 7 is a top plan view of the ramp structure without the bracket of FIG. 6.

The upper face of the arm 62 is shown at 66 and it will be seen that this, in the closed position of the door, is spaced from the turned-down edge 54.1 which lies thereabove. The face of the edge 54.1 constitutes an abutment surface of the door and the co-operating portion of the arm constitutes an abutment face on the arm. When the outer end of the arm 62 is lifted upon the roller 64 encountering a ramp (see FIGS. 6 etc.), there is some lost motion between the arm 62 and the door 16. More specifically, the arm 62 lifts, pivoting about the pin 60 with respect to the door 16, until the gap between this turned-down edge 54.1 and the arm has been taken up. Thereafter, further swinging movement of the arm 62 in an upward direction towards the dotted line position shown in FIG. 2 causes the door 16 to lift. It will be noted that in this position the arm 62 is in engagement with the turned-down edge 54.1. Discharge of the material in the hopper body then takes place, the material sliding downwardly over the walls 34 and 42 and through the rectangular frame constituted by the channel 24 and I-beams 26.

The arm 62 includes two plates 68 which are parallel to one another but spaced apart in the longitudinal direction of the car. Each of these plates has a stepped undersurface, the arrangement being such as to provide two faces 70 which, in the closed condition of the door, are vertical.

The upper face 66 of the arm 62 is constituted by the parallel, aligned, upper faces of the plates 68.

As will be seen from FIG. 2, the faces 70 engage one edge of the upper flange 72 of the longitudinal I-beam 26 so that, in the closed condition of the door, lateral movement of the arm and door towards the open position is prevented. During the upward lost motion of the arm 62 with respect to the base plate 54, the faces 70 clear the edge of the upper flange 72 of the I-beam 26. Consequently, by the time the arm engages and commences to lift the door in its outward swinging movement, the vertical faces 70 are clear of the I-beam which, as a consequence, does not hinder such movement.

During the closing movement of the door, the door and arm swing downwardly together until the door reaches its fully closed position. Thereafter the arm moves downwardly away from the door and the faces 70 are re-engaged with the flange 72. Downward movement of the arm 62 ceases when the surfaces 62.1 of the arm come to rest on the I-beam 26.

The axis of rotation of the roller 64 is shown at X in FIG. 2 and it will be seen that this passes through the common axis of the pivot structures 52. The curved base plate 54 of the door 16 is generated about the longitudinal axis Y.

By off-setting the axis Y horizontally from the common axis of the pivot structures 52, the motion imparted to the door 16, while being a true pendulum motion, includes a downward component with respect to the stationary parts of the hopper. This means that those portions of the door which are in sealing engagement with the lower edges of the walls 34 and 42 of the hopper body do not simply swing laterally with respect thereto which can cause ore or other material to be trapped therebetween. Instead, said portions simultaneously swing laterally and move downwardly with respect to said stationary parts, so that gaps of progressively increasing width are created. This obviates the possibility of ore wedging the door solidly to the body and thereby prevents the car being tipped over by the ramp.

The chassis 12 incorporates, on each side thereof, a skirt 74 which prevents spreading of the load when it is being discharged. The skirts 74 are themselves stiffened by angle irons 76.

The two skirts are cut away to provide clearance for the wheels of the vehicle and the wheel arches thus formed are strengthened by welding on elements 80 (see FIG. 1).

As will be seen from FIG. 1, there are, at the upper ends of the end walls 36 of the hopper body 14, diverging guide walls 82 and 84 which constitute overhanging portions of the body. The guide wall 82 slopes at an angle of less than 45 degrees and terminates in a downwardly directed lip 86. The wall 84 slopes at about 45 degrees and also terminates in a lip 88. A comparison of the wall 82 with the wall 84 reveals that, when two hopper cars are coupled end-to-end in a train, the wall 84 and its lip 88 overhang the wall 82 and its lip 86. Thus, when the car is filled while moving under a continuous discharge of ore or the like, the overhanging walls 82 and 84 ensure that material cannot be dumped between the cars onto the track.

When the hopper cars negotiate a bend in the track, the laterally outer ends of the wall 82 move one forwardly and one rearwardly with respect to the overhanging wall 84. To prevent engagement of the wall 82 with the wall 84, the end portions of the wall 84 are formed with vee-shaped notches 90 as shown in FIG. 2. With this arrangement the ends of the wall 82 swing into these notches so that the train can round the bend safely without any of the trucks being de-railed.

Turning now to FIGS. 6 to 9, these Figures show a ramp structure 144 having an upwardly sloping, door-opening section 146, a flat apex section 148 and a downwardly sloping door-closing section 150. The ramp structure 144 comprises a cam track 152 mounted on an angle iron 154 which is itself supported on uprights 156 braced by a longitudinal bar 158. The lower ends of the uprights include pivot arrangements by means of which the entire ramp structure can be swung away from the railway tracks to permit non-hopper traffic to pass freely. Stiffeners 160 arranged at intervals along the ramp structure support the contoured cam track 152 on the angle iron 154.

A bracket structure 162 is provided adjacent the lower end of the door-closing section 150 for the purpose of forcing the arm 62 downwardly to the position in which the faces 70 lie adjacent the upper flange 72 of the I-beam 26.

The bracket structure 162 includes two supports 164 which have vertical slots 166 therein. The vertical flange of the angle iron 154 has apertures 168 therein, this arrangement permitting a degree of adjustment of the bracket structure 162 with respect to the cam track 152. A plate 170 is mounted on the supports 164, the plate 170 having a major face 172 which is parallel to and spaced from the face of the cam track 152. The end portions of the plate 170 are bent outwardly to provide lead-in and lead-out sections to the slot defined between the cam track 152 and the major face 172.

As the roller 64 engages the door-opening section 146, the arm 62 is lifted, the initial upward movement freeing the faces 70 from the I-beam 26 and subsequent movement fully opening the door. After passage across the ramp apex, during which period the door is held fully open, the door begins to close and is fully closed when the roller 64 encounters the bracket structure 162. The roller 64 passes between the cam 152 and the major face 172, and the major face 172 acts on the wheel to force the arm 62 downwardly to re-engage the faces 70 with the I-beam 26.

The profile of the cam track 152 is such as to apply a force to the roller 64 which is at a tangent to the arc scribed by the door and wheel about the door pivot structures 52. Stated another way, the line of force between the wheel and the cam track is at right angles to a line which is itself at right angles to the pivotal axis of the pivot structures 52 and co-incides with the axis of rotation of the roller 64. Thus, while the roller 64 is engaged with the cam track, the opening force is at all times at right angles to the rotational axis of the roller 64. If reference is made once more to FIG. 2, the cam track 152 is shown in chain-dotted lines in that Figure, and the direction of the force exerted on the roller 64 is indicated by the arrow A. It will be seen that this is at right angles to the axis X which is the axis of rotation of the roller 64 and passes normally through the common axis of the pivot structures 52.

In practice the arrangement described means that ideally the sections 146 and 150 are helical in shape, the generating axis of the helix being the common axis of the pivot structures 52. In practice, because of the radius of the roller 64, the generating axis is offset downwardly from said common axis.

The ramp structure 144 has been described as it operates when a train of hopper cars moves from right to left. However, it will be understood that by providing a further bracket structure 162 in conjunction with the section 150, the ramp structure can handle trains running in either direction.

I claim:

1. A bottom discharge hopper structure comprising (a) a chassis frame;

(b) a body mounted on said chassis frame and bounded by two longitudinally extending side walls, said side walls both sloping downwardly and inwardly so as to converge with one another to from a bottom discharge opening;

(c) a single door hung from pivot structures above said chassis frame and serving to close said opening, said door comprising two end plates, an elongated plate of arcuate cross-section joining said end plates, and a first abutment surface;

(d) a tipping arm pivotally mounted on said door and having a second abutment surface, said arm having a first position with respect to said door in which first position said abutment surfaces are spaced apart and a second position with respect to said door in which second position said abutment surfaces are in engagement;

(e) a face on said arm being in engagement with said frame to latch said door while said arm is in its first position with respect to said door, to prevent pivotal movement of said arm and door about said mounting structures until said arm has been pivoted sufficiently about its mounting on said door towards said second position to take up at least some of the gap which exists between said abutment surfaces while said arm is in its first position, said elongated plate being generated about an axis offset with respect to the axis of said pivot structures in such manner that said elongated plate moves both downwardly and laterally with respect to said side walls, thereby to cause a gap of progressively increasing width to be created between said door and said walls during opening.

2. A bottom discharge hopper structure comprising (a) a chassis frame;

(b) a body mounted on said chassis frame and bounded by two longitudinally extending side walls, said side walls both sloping downwardly so as to converge with one another to form a bottom discharge opening;

(c) a single door hung from pivot structures above said chassis frame and serving to close said opening, the door having a first abutment surface;

(d) a tipping arm pivotally mounted on said door and having a second abutment surface, said arm having a first position with respect to said door in which first position said abutment surfaces are spaced apart and a second position with respect to said door in which second position said abutment surfaces are in engagement;

(e) a face on said arm being in engagement with said frame to latch said door while said arm is in its first position with respect to said door, to prevent pivotal movement of said arm and door about said pivotal mounting structures until said arm has been pivoted sufficiently about its mounting on said door towards said second position to take up at least some of the gap which exists between said abutment surfaces while said arm is in its first position; and (f) a roller carried on the end of said arm remote from its mounting on said door, the axis of rotation of said roller intersecting the axis of said pivot structures.

3. A hopper structure as claimed in claim 2, wherein said door comprises two end plates and an elongated plate of arcuate cross-section which joins said end plates, said elongated plate being generated about an axis offset with respect to the axis of said pivot structures in such manner that said elongated plate moves both downwardly and laterally with respect to said side walls, thereby to cause a gap of progressively increasing width to be created between said door and said walls during opening.

4. A bottom discharge hopper structure comprising (a) a chassis frame;

(b) a body mounted on said chassis frame and defining a bottom discharge opening;

(c) a door hung on said body above said chassis frame for swinging movement about a horizontal pivot axis, said door having an abutment surface;

(d) a tipping arm pivotally mounted on said door about a horizontal pivot axis and also having an abutment surface, said arm extending from an inner end inwardly of said chassis frame to an outer end beyond said chassis frame, said inner end being pivotally mounted on said door and said outer end having a rotatable roller thereon, said arm having a first position with respect to said door in which first position of said arm said abutment surfaces are spaced apart and a second position with respect to said door in which second position said abutment surfaces are in engagement;

(e) a face on said arm which face is in engagement with said frame to latch said door while said arm is in its first position with respect to said door, to prevent pivotal movement of said arm and said door about the pivot mounting of said door until said arm has been pivoted sufficiently far about its mounting on said door towards said second position to take up at least some of the gap which exists between said abutment surfaces while said arm is in its first position.

5. In combination, a bottom discharge hopper structure comprising (a) a chassis frame;

(b) a body mounted on said chassis frame and bounded by two longitudinally extending side walls, said side walls both sloping downwardly so as to converge with one another to form a bottom discharge opening;

(c) a single door hung from pivot structures above said chassis frame and serving to close said opening, said door having a first abutment surface;

(d) a tipping arm pivotally mounted on said door and having a second abutment surface, said arm having a first position with respect to said door in which first position said abutment surfaces are spaced apart and second position with respect to said door in which second position said abutment surfaces are in engagement;

(e) a face on said arm being in engagement with said frame to latch said door while said arm is in its first position with respect to said door, to prevent pivotal movement of said arm and door about said pivotal mounting structures until said arm has been pivoted sufficiently about its mounting on said door towards said second position to take up at least some of the gap which exists between said abutment surfaces while said arm is in its first position;

(f) a roller carried on the end of said arm remote from its mounting on said door, the axis of rotation of said roller intersecting the axis of said pivot structures; and (g) a cam track profiled so that the line of action of the force exerted by said cam track on said element is always tangential to the arc described by said arm and said door about the pivotal mounting of said door.

* * * * *